United States Patent [19]

Mäkelä

[11] Patent Number: 5,035,135

[45] Date of Patent: Jul. 30, 1991

[54] CAR BODY FRAME STRAIGHTENING APPARATUS

[75] Inventor: Toivo Mäkelä, Hyvinkää, Finland

[73] Assignee: Raine Vierto, Selki, Finland

[21] Appl. No.: 376,050

[22] PCT Filed: Sep. 30, 1988

[86] PCT No.: PCT/FI88/00158

§ 371 Date: Jul. 26, 1989

§ 102(e) Date: Jul. 26, 1989

[87] PCT Pub. No.: WO89/02791

PCT Pub. Date: Apr. 6, 1989

[30] Foreign Application Priority Data

Oct. 1, 1987 [FI] Finland ..... 874313

[51] Int. Cl.[5] ..... B21D 1/12

[52] U.S. Cl. ..... 72/422; 72/705; 269/97; 269/236

[58] Field of Search ..... 72/422, 705; 269/97, 269/98, 229, 235, 236

[56] References Cited

U.S. PATENT DOCUMENTS

| | | | |
|---|---|---|---|
| 2,233,458 | 3/1941 | Segre | 269/98 |
| 2,439,151 | 4/1948 | Spinnler | 269/236 |
| 3,441,264 | 4/1969 | De Gaston | 269/97 |

FOREIGN PATENT DOCUMENTS

| | | |
|---|---|---|
| 7804107 | 12/1981 | Switzerland . |
| 1401700 | 7/1975 | United Kingdom . |

*Primary Examiner*—Lowell A. Larson

*Attorney, Agent, or Firm*—Barnes & Thornburg

[57] ABSTRACT

A car body frame straightening apparatus consisting of a frame jig and a rim clamp having an adjustable attachment to the jig frame and comprising of a pair of jaws clamping to the body rim. One jaw (3) of the rim clamp is permanently fixed to a body piece (5) of the rim clamp (2) while the other, an adjustable clamp (4), is clampable by means of an eccentric clamping member (6) against the other jaw (2) in such a way that the rim clamp is clamped by virtue of an other set of eccentric elements (7, 8), which exert a clamping effect on the jig frame 1, to attach to the beam frame.

4 Claims, 2 Drawing Sheets

CAR BODY FRAME STRAIGHTENING APPARATUS

The present invention relates to a car body frame straightening apparatus consisting of a frame jig and a body rim clamp having an adjustable attachment to the jig frame and comprising a pair of jaws which clamp to the body rim.

In conventional car body frame straightening equipment, the rim clamps are assembled from flat and angle profile clamp pieces attached to a frame jig. The attachment takes place using multiple bolts. This kind of a rim clamp known in the art is exemplified in FIG. 1 of the patent application.

The aim of the present invention is to achieve a totally new kind of car body frame straightening apparatus in which the rim clamp is implemented as a single piece allowing quick and easy use. The car body frame straightening apparatus in accordance with the invention is characterized by having one jaw of the rim clamp permanently fixed to the body piece of the rim clamp while the other jaw, or the adjustable jaw, is clampable by an eccentric cam lever against the first jaw so that the locking operation of the rim clamp fixes the clamp firmly to the jig frame beam or rail by means of another set of eccentric elements effecting on the jig frame. By virtue of the invention, a car body frame can be attached extremely quickly at its rim to the straightening apparatus while the straighteninq apparatus is simultaneously clamped to the jig frame of the apparatus. With the help of the invention, the use of separate, easily lost fixture pieces, such as iron spacers and bolts, become obsolete.

A preferred embodiment of the invention is characterized in that the body rim clamp attachment to the jig frame beams and clamping to the body rim is implemented with the help of a locking lever belonging to the rim clamp, with the pivoting shaft of the lever carrying an eccentric member, such as an eccentrically placed shaft, whose eccentric rotation is effective on the movable jaw. The pivoting shaft carries an eccentric member, such as cam rollers placed eccentrically to the sides of the shaft, with the eccentric movement of the rollers exerting a clamping effect on the jig frame beams. The movable jaw is pivotally mounted to the rim clamp so that the movement of the eccentric element placed on its shaft also exerts a clamping effect on the jig frame beams. By virtue of this arrangement, a single locking lever is sufficient for performing all required attachments, that is, the attachment of the body rim to the body rim clamp and attachment of the body rim clamp to the jig frame beams of the straightening apparatus.

The invention is next examined in detail with help of the following exemplifying embodiment illustrated in the attached figures.

Figure 1:
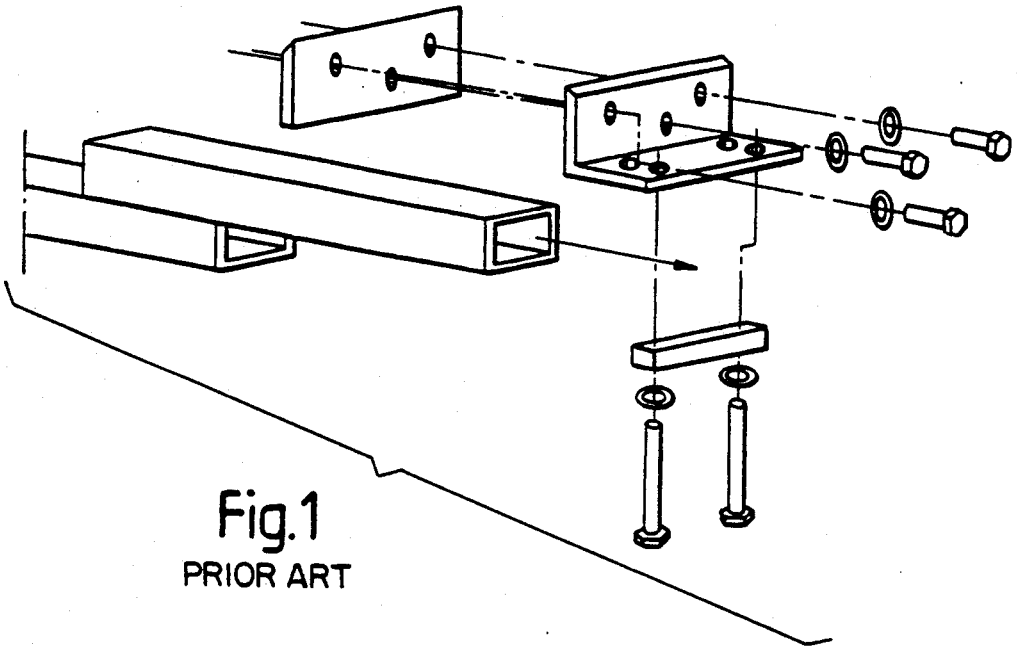
Fig.1 PRIOR ART
FIG. 1 shows the rim clamp of a car body frame straightening apparatus of the prior art.
Figure 2:
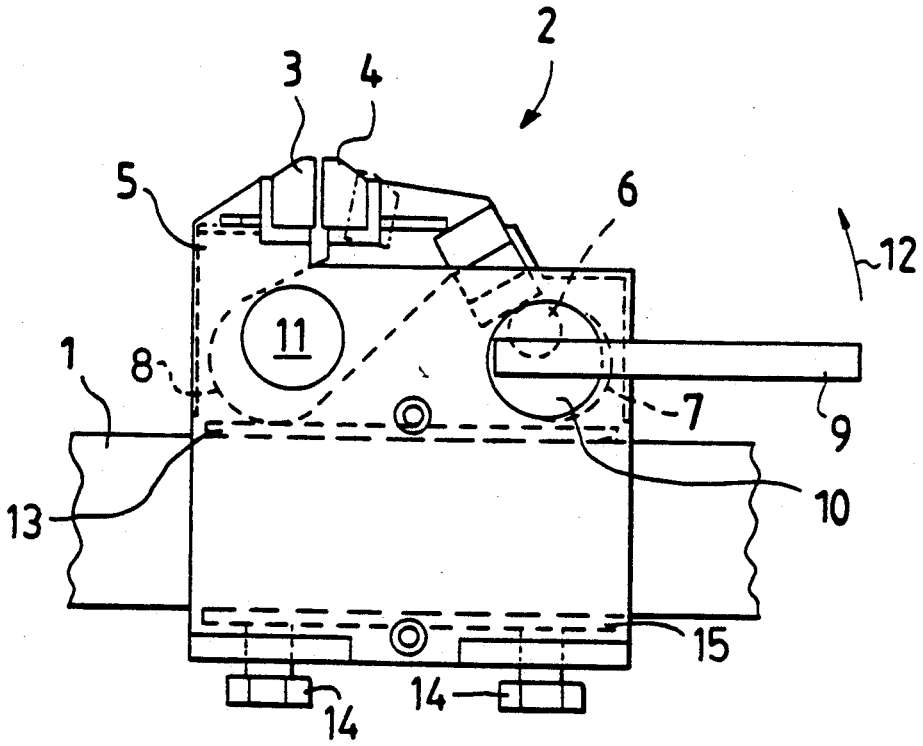
FIG. 2 shows a rim clamp of the straightening apparatus in accordance with the invention in a side view.
Figure 3:
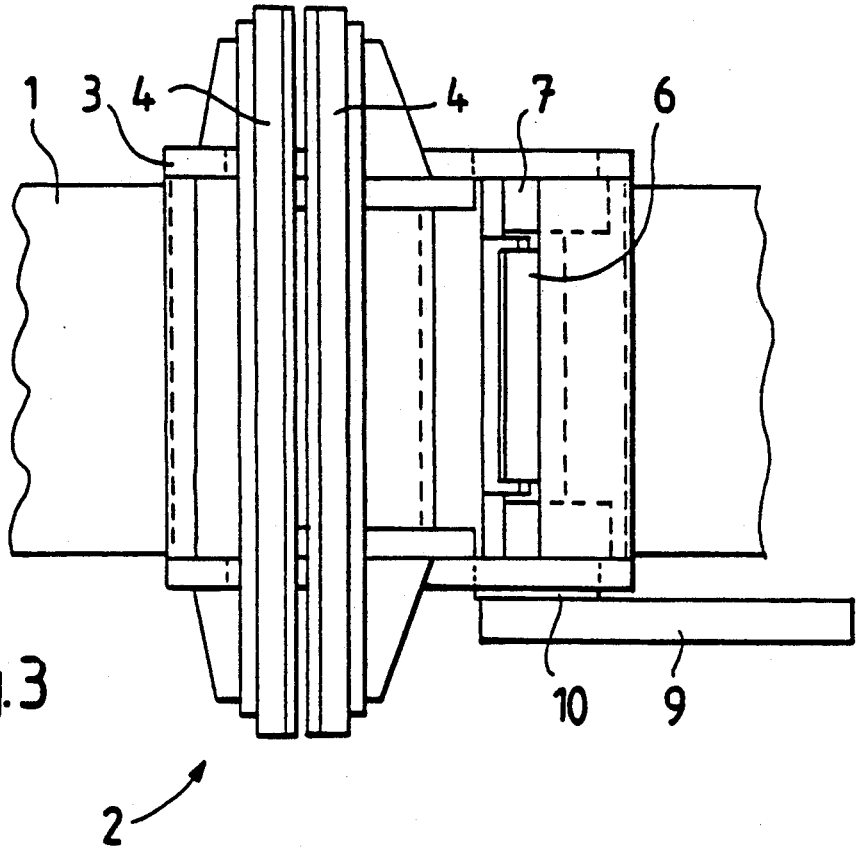
FIG. 3 shows the same element as illustrated in FIG. 2 in a top view.
Figure 4:
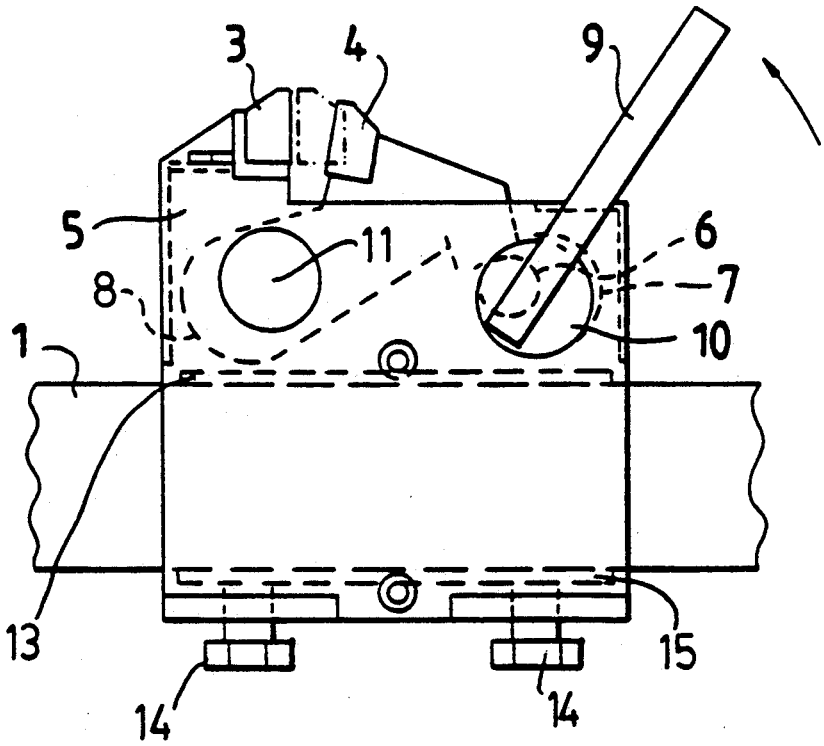
FIG. 4 shows the same element as illustrated in FIG. 2 in an opened position of the rim clamp.

The straightening apparatus incorporates a jig beam frame 1 and a rim clamp 2, adjustably attachable to the jig frame, with the clamp comprising a pair of jaws 3, 4 clampably attaching to the car body rim. One jaw 3 of the rim clamp is permanently fixed to a body piece 5 of the rim clamp 2, while the other, an adjustable clamp 4, is clampable by means of an eccentric clamping member 6 against the other jaw 2. The rim clamp is clamped by virtue of another set of eccentric elements 7, 8, which exert a clamping effect on the jig frame 1, to attach it the beam frame. The attachment of the rim clamp to the frame 1 as well as its clamping attachment to the car body rim is effected by a locking lever 9 incorporated with the rim clamp. The lever 9 is attached to pivot shaft 10 which carries the eccentric member 6, such as an eccentrically placed shaft, whose eccentric movement exerts a clamping effect on the movable jaw 4. The pivoting shaft 10 carries an eccentric member, which comprises cam rollers 7 mounted to the sides of the shaft 6, with the eccentric movement of the rollers exerting a clamping effect on the jig beam. The movable clamping jaw 13 is pivotally mounted to the rim clamp so that the movement of the eccentric element 8 mounted on the shaft 11 is also effected on the jig frame 1. By lifting the locking lever 9 in the direction shown by an arrow 12, the jaws 3, 4 as well as the eccentric elements 7, 8 release the clamping attachment of the rim clamp from the jig frame beam. With the help of this arrangement, the rim clamp is adjustable to a desired position on the jig frame beam as well as quickly reattachable to the jig frame and simultaneously to the car body rim.

To assist in initially locating the rim clamp 2 on the jig beam frame 1, the fixed clamping member 15 which cooperates with clamping member 13 can be adjusted through screws 14.

What is claimed is:

1. A car body frame straightening assembly comprising:

a frame jig;

a rim clamp having a first jaw movable thereon and a second jaw fixed thereon;

an adjustment means for adjustably clamping the rim clamp to the frame jig while at the same time clamping the first jaw against the second jaw;

wherein said adjustment means comprises two eccentrics driven by a first and second cam, respectively;

wherein the first and second cams are mounted on a single shaft for rotation;

wherein the first eccentric means is located on the movable first jaw to cause the movable first jaw to be brought into clamping position with the second jaw by the first cam means when the shaft is rotated; and wherein the second eccentric is mounted on a movable clamping means on the rim clamp which presses against the frame jig to clamp the rim clamp to the frame jig in response to rotation of the second cam means when the shaft is rotated.

2. A car body frame straightening assembly according to claim 1 wherein there is a single handle means for rotating the shaft.

3. A car body frame assembly according to claim 2 wherein there is an auxiliary adjusting mechanism for positioning the second jaw means with respect to an article to be clamped by initially locating the position of the rim clamp on the frame jig by a screw clamp.

4. A car body frame assembly according to claim 1 wherein there is an auxiliary adjusting mechanism for positioning the second jaw means with respect to an article to be clamped by initially locating the position of the rim clamp on the frame jig by a screw clamp.

* * * * *